United States Patent [19]

Crump

[11] 4,320,916

[45] Mar. 23, 1982

[54] EQUIPMENT CARRYING AND, OR, SECURING DEVICE

[76] Inventor: John M. Crump, 1018 Parkridge Cir. W., Jacksonville, Fla. 32211

[21] Appl. No.: 175,081

[22] Filed: Aug. 4, 1980

[51] Int. Cl.[3] ..... A45F 5/10

[52] U.S. Cl. ..... 294/147; 294/163; 294/165

[58] Field of Search ..... 294/147, 163, 165

[56] References Cited

U.S. PATENT DOCUMENTS

| | | | |
|---|---|---|---|
| 2,956,813 | 10/1960 | Madden | 224/45 S |
| 3,209,970 | 10/1965 | Canell | 224/917 X |
| 3,210,787 | 10/1965 | Allsop | 12/120.5 |
| 3,248,027 | 4/1966 | Pfleider | 224/45 S |
| 3,260,430 | 7/1966 | Sandenburgh | 224/45 S |
| 3,272,413 | 9/1966 | Pfleider | 224/45 S |
| 3,718,242 | 2/1973 | Larson | 224/45 S |
| 3,909,718 | 9/1975 | Allsop et al. | 224/45 S |
| 3,990,655 | 11/1979 | Coxell | 224/45 S |
| 4,190,182 | 2/1980 | Hickey | 224/45 S |

*Primary Examiner*—Steven M. Pollard

[57] ABSTRACT

The invention is a device for assembling, transporting, displaying, packaging, carrying and, or, securing any desired combination of equipment such as skis, poles and boots. The device includes oppositely disposed equipment retainer means symmetrically related and movably mounted in a mutually aligned relationship relative to a base member. Said retainer means being selectively adjustable to allow any desired combination of said equipment, or the like, to be retained therewith. Manipulatable securing means is provided such that the said retainer means may be adjusted to accomodate various equipment sizes and also to provide a method whereby the consequential assembling of any combination of said equipment causes said equipment to be releasably secured therewith and further providing means incorporated into the same device for locking said device with a cable type security lock, or the like.

11 Claims, 5 Drawing Figures

EQUIPMENT CARRYING AND, OR, SECURING DEVICE

DESCRIPTION

TECHNICAL FIELD

The present invention relates to a device for carrying, storage, transporting, assembling, packaging, displaying and/or securing any combination of equipment such as skis, poles and boots, or the like, while simultaneously providing a method of assembling such equipment in a single, integral means for securing the complete device and any combination of equipment retained therewith when a skier leaves the equipment unattended in a ski resort, public area, or any place where convenience and security are desired for such equipment.

BACKGROUND ART

The prior art, U.S. Pat. No. 3,210,787, provides for boot carrying only. U.S. Pat. No. 3,990,655 provides for ski and pole carrying and securing. Each of these devices is limited to their independent uses.

This applicant has disclosed other embodiments of the present invention in application Ser. No. 06/057,306 dated July 13, 1979, 06/125,340 dated Feb. 28, 1980, and 06/128,673 dated Mar. 10, 1980.

DISCLOSURE OF INVENTION

In accordance with the present invention, I provide a method of assembling skis, poles and boots, or the like, into a single, integral device having cooperable members for carrying and/or securing any desired combination of equipment such as skis, boots and poles. The device includes a pair of mutually aligned oppositely disposed and symmetrically related cooperable retainers, each selectively movable on a centrally located column member, one of the retainers being adapted to cooperate with a base portion to form a pair of ski and pole magazine retention chambers. The device consisting of a unitary mechanism having relatively symmetrically configured movable parts that may be selectively manipulated into variable positions to receive boots, skis and poles into releasable securement therewith and which may be locked in their enclosed or retaining positions.

My improved carrying and securing device provides a novel method of assembling and the advantage that the cooperable parts are adjustable and selectively manipulatable thereby allowing the device to not only be utilized to accomodate the full range of equipment sizes but to also be retracted to a minimum height when the device is utilized for carrying and/or securing skis and poles without boots.

The single adjustable securing and locking means is common to all adjustment and utilization features inherent in this invention such that the device is positively secured in a selected equipment retention position. This feature is of particular advantage since it provides in one single device the capability and methods of carrying and/or securing any desired combination of skis, poles and boots. Other objects and advantages reside in certain novel features of the method of assembly, arrangement and combination of parts which will be hereinafter more fully described and particularly pointed out in the appended claims, reference being made to the accompanying drawings forming a part of this specification.

BRIEF DESCRIPTION OF DRAWINGS

The details, features and principles of my invention, as well as further objects and advantages will be more fully understood by reference to the accompanying drawings and following detailed description, which disclose, by way of example the presently preferred but none the less illustrative embodiment in accordance with the mode contemplated of applying that principle, in which.

BEST MODE FOR CARRYING OUT THE INVENTION

Figure 1:
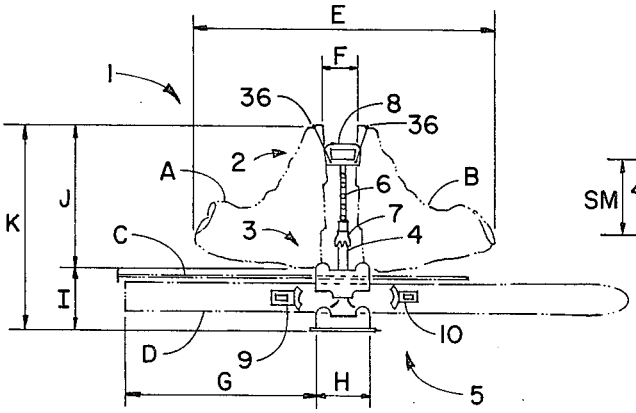
FIG. 1 is a view in side elevation illustrating the method of assembling a class of equipment embodying the present invention.

Referring now specifically to the drawings and first to FIG. 1, there is shown and illustrated a method of assemblage embodying features and principles of the present invention, generally designated by the reference numeral 1, which includes a pair of boots A and B together with a pair of skis D and their accompanying poles C secured into the illustrated assemblage by means of a centrally disposed device comprising a pair of mutually aligned, selectively manipulatable, and cooperative boot retainer units 2 and 3 each slidable or movably mounted to a base column 4 which in cooperation with base member 5, handle column 6, securing means 7 and hand grasp 8 provide a means for selectively carrying and/or securing any combination of boots, skis and poles. Skis D are confined longitudinally within base 5 by ski bindings 9 and 10. FIG. 1 illustrates an assemblage of equipment having a characteristic longitudinal side profile with dimensions E, F, G and H and compact vertical dimensions I, J and K. Observe that when boots A and B are not secured therewith dimension J becomes substantially zero thus causing dimension K to approach dimension I. When skis D and poles C are not secured therewith dimension K approaches dimension J. Dimension F may be selected in cooperation with securing means dimension V in order to achieve adequate operational freedom together with hand grasp comfort.

Figure 2:
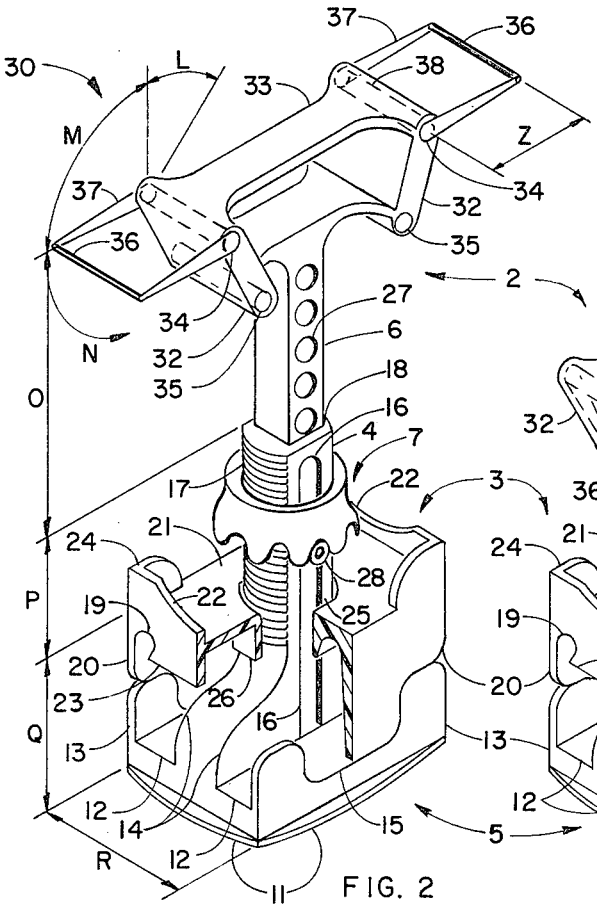
FIG. 2 is a partial cross sectional perspective view, illustrating the device in extended position as at the beginning of an equipment assembling operation or conclusion of an equipment removal operation.

The broad theory of the carrying and/or securing principles of this invention are further disclosed in FIG. 2 wherein the base member 5 is shown as being generally rectangular in shape or configuration including arcuate flanges 11 and portions thereof at different levels to form the lower part of a pair of oppositely disposed ski chambers having substantially flat ski support bases 12, upstanding longitudinally extending side walls 13 and centrally disposed upstanding base column member 4. End walls 14 extend longitudinally from base column 4 providing interior side walls for ski chambers and structural reinforcing for base member 5 and column 4. Each of the side walls 13 has a central recess section 15 the bottom edge of which is coplanar with the top surface of ski support bases 12 and generally shaped to cooperate with lower boot, ski and pole retainer unit 3. Each of the side walls 14 has a central elongated aperture 16 symmetrically about base column 4 for cooperation with securing means 7. A portion column 4 exterior surface is provided with threads 17 also for cooperation with securing means 7. Base column member 4 has a central cavity extending downwardly thus providing a receiving opening 18 for adjustable handle column 6. Thus FIG. 2 illustrates, among other things, the synergistic characteristics of base column member 4 as it cooperates with the selectively manipulatable parts 3, 6 and 7.

Lower boot, ski and pole retainer unit 3 comprised of two symetrically disposed longitudinally extending pole chambers 19 with downwardly depending side walls 20 having central located extension portions generally terminating to cooperate with side walls 13 of base member 5. Unit 3 generally rectangular in shape conforming substantially to the plan configuration of base member 5. However, for simplicity of description Unit 3 and its side walls 20 are shown having a substantially flat top structure 21 bridging therebetween with symetrically disposed upstanding boot retention lips 22 generally perpendicular to axis of pole chambers 19 and integral with end walls 23 which in turn comprises part of the ski retention means. Lips 22 extend around and partially along side walls 20 forming side retention lips 24 which facilitate holding of boots and also reinforce the structural unit 3. A centrally located slot, noted as base column aperture 25, extends through top surface 21 and includes a downwardly depending perimeter wall 26. The pole chambers 19 may be provided with reinforcing ribs (not shown) to aid in lending rigidity to the structure and providing snap-in releasable pole holding features. In a similar manner, the side walls 20 may be provided with reinforcing ribs for added strength and structural rigidity. Aperture 25 is shaped to conform with exterior configuration of column 4 thus guiding unit 3 vertical motion and restraining against rotational motion.

Figure 3:
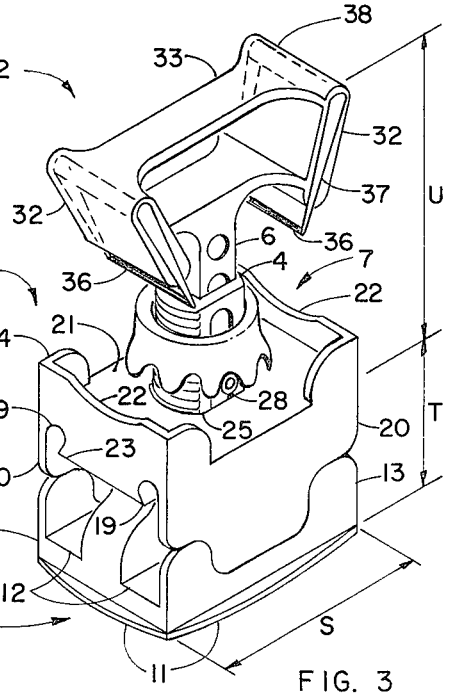
FIG. 3 is a perspective view illustrating the device in retracted position.

Slidably mounted within base column 4 is handle column 6 having a pluanity of adjustment apertures 27 adapted to cooperate with a locking pin 28 which when operated in conjunction with securing means 7 provides for adjustment and locking of device 30 in FIG. 2 and device 31 in FIG. 3. Symetrically disposed and extending upwardly from handle column 6 are a pair of generally upstanding sloping, substantially, similar, handle hand grasp end abutments 32. Said abutments 32 are disposed transversely to the longitudinal axis of pole chambers 19 and form the end walls of hand grasp 33. The abutments 32 are each formed with a pair of openings 34 and 35 for the purpose of rotatably supporting boot retainers 36 which may be selectively installed in either openings 34 or 35 depending upon length of boots A and B relative to extended length O, P, Q of device 30 in FIG. 2.

Retainers 36 include side members 37 and rotation support shaft 38 and may be formed for snap-in type fastening (not shown) to abutments 32. Thus once the retainer shafts 38 are inserted into openings 34, 35, and their ends snap locked together, the retainers 36 are free to rotate within zones identified by L, M and N but cannot be removed from the openings since there is no access to unsnap the snap lock (not shown). The exterior flat surface of abutments 32 are sloped to cooperate with boots A and B relative to lower boot retention lips 22. Integral with abutments 32 and bridging therebetween is a substantially flat hand grasp structure 33.

Figure 4:
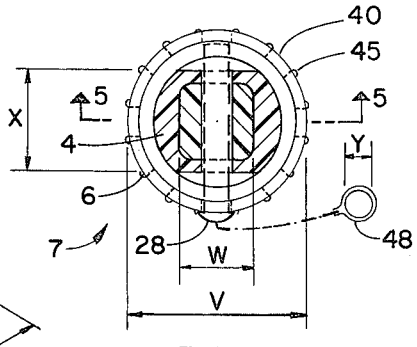
FIG. 4 is an enlarged partial cross sectional plan view of adjustable and manipulatable securing means.

As best seen in FIGS. 2 and 3, the securing means 7 is adjustably engaged to portions of the exterior surface of base column 4 by means of threads 17 or other equivalent detachable mounting means. Referring to FIGS. 2, 3, 4 and 5 there is shown an illustrated selectively manipulatable securing means 7 cooperating with removable locking pin 28. Securing means 7 has a cylindrical or tubular type casing circumferentially enlarged to dimension V at its lower end with a plurality of circumferentially located locking apertures 40. The securing means 7 itself has a relatively short axial length SM and an upper portion reduced in diameter for thread 41, or equivalent, detachable engagement with threads 17 of base column 4. The lower interior counterbored cavity 42 provides shoulder means 43 which is the surface in contact with locking pin 28. Locking pin 28 has a diameter and length such that it is captive within the counterbore cavity 42 and the diameter of pin 28 is greater than the apertures 40. Pin 28 has a longitudinal aperture 44 for passage of a locking cable (not shown). Preferably, the outer peripheral surface of means 7 is knurled, roughened or provided with turning ribs 45 in order to facilitate manipulation. Pin 28 may be provided with indexing nubs (not shown) such that it registers properly when inserted into apertures 27. In FIG. 4 column 6 has dimension W with column 4 having dimension X. Locking pin 28 may be provided with a tether ring 48 having dimension Y suitable for detachable connection about column 6.

Securing means 7 may be located integral with column 6 such that the turning means is positioned just below hand grasp 33.

Figure 5:
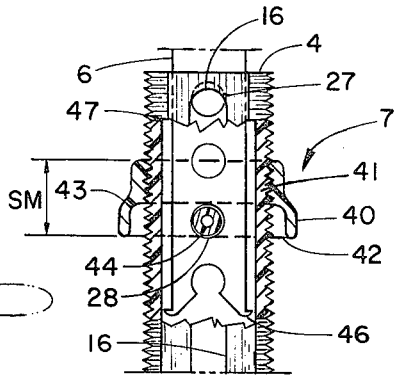
FIG. 5 is a partial cross sectional view taken on the line 5—5 of FIG. 4.

Handle column 6 has been illustrated as generally rectangular in cross section conforming generally to aperture 18 in column 4. It should be noted that the cross sectional configuration of column 6 and aperture 18 may be any shape consistent with the functional and structural features of the invention. This includes circular members and multiple members to achieve both stability and adjustment. In FIG. 5 the lower end of column 6 is shown with a pair of oppositely disposed shear keys 46 which in cooperation with a pair of shear key stops 47 at the upper interior portion of column 4 provide means whereby column 6 cannot be accidently fully retracted from column 4.

Turning now to FIG. 3 there is shown device 31 with handle column 6 retracted downwardly into base column 4 illustrating the general configuration of the invention when utilized for carrying and/or securing poles C and skis D without boots A and B and having profile dimensions S, T and U. Boot retainers 36 have been rotated downwardly into a position parallel with and rearwardly of sloping abutments 32. Securing means 7 together with locking pin 28 have been manipulated to achieve the mutually cooperative position of parts 4, 6, 7 and 28 thereby providing a device 31 for carrying and/or securing poles C and skis D. Observe that the cooperable aspects of securing means 7 with columns 4 and 6 together with pin 28, apertures 27 and slot 16 allow means 7 to normally function in the upper region of column 6 thus achieving more freedom between dimensions F and V.

While plastic is considered the suitable material it is understood that the device 30 can be manufactured from a variety of materials including wood, and skeletonizing metal wire forming. Furthermore, the selection of alternate materials introduces considerations of engineering properties such as shear strength, yield, tensile strength, density, poisson's ratio, fatigue strength, corrosion resistance and other properties which when considered together with the fabrication tooling techniques can have an influence upon members the exterior appearance of device 30 while at the same time utilizing the novel characteristics of the invention described hereinbefore. Thus, the three main parts 2, 3 and 5 are each preferably formed as unitary members molded from a suitable plastic each cooperating with the other to provide the important features of construction necessary for compactness, simplicity, ruggedness, lightweight and uniquely adapted to engage ski equipment utilizing the method of assemblage described herein.

OPERATION OF THE INVENTION

Operationally, device 30 of FIG. 2 provides a method whereby a class of equipment such as skis, poles and boots, may be carried and/or secured in an assemblage 1 illustrated in FIG. 1. Therefore, device 30 comprises a pair of mutually alligned, selectively manipulatable equipment retainer units 2 and 3 movable mounted for cooperating with a base member 5 whereby any combination of boots A and B, poles C and skis D may be assembled therewith and subsequently releasably engaged therewith by manipulation of securing means 7 such that the consequential selective engagement of the cooperable parts thus illustrated causes any desired combination of equipment such as skis D, poles C and boots A and B to be releasable secured with device 30.

Assuming an initial device 30 posture as shown in FIG. 2 and that it is desired to assemble equipment such as that illustrated in FIG. 1. First, manipulate securing means 7 by counterclockwise rotation about column 4, assuming right hand threads 17 and 41, thereby causing means 7 to move upwardly on column 4. Secondly, move lower retention unit 3 upward allowing poles C to be secured into pole chambers 19 after which skis D can be placed into ski support bases 12 following which retention unit 3 is lowered downward onto top of skis D. Thirdly, raise handle 33 up with one hand while placing heel of boot A onto retainer lips 22 following which upper retainer 36 is placed over the toe of boot A. Fourthly, repeat third step for boot B. Fifth, apply slight downward force on handle 33 while simultaneously turning means 7 clockwise thereby causing means 7 to move downwardly into contact with pin 28 thus causing the assembled equipment to be releasably secured with device 30. A locking cable, not shown, may now be communicated through apertures 40 and pin aperture 44 thereby locking device 30 against unwanted removal and/or use when attached to some convenient stationary object. Once pin 28 is located in the proper aperature 27 for a given equipment size it is not necessary to remove pin 28 during subsequent equipment removal or installation since the manipulation of means 7 provides ample retractile motion to preform the above assembly steps.

Should the initial posture be that of device 31 shown in FIG. 3, and it is desired to assemble poles C and skis D without boots A and B, then it is only necessary to manipulate securing means 7 counterclockwise causing means 7 to move upward on base column 4. Lower retainer unit 3 may now be raised upward about base column 4 causing pin 28 and hand grasp 33 to also move upward thereby causing dimension T to enlarge thus providing freedom for installation of poles C into pole chambers 19 which are constructed for snap-in type retention to facilitate installation of skis D. With unit 3 held in the upward position skis D are installed onto ski support bases 12 following which unit 3 is lowered thereby causing poles C and skis D to be retained within the oppositely disposed and mutually aligned side walls 13 and 20. Securing means 7 may now be manipulated clockwise causing it to move downward into contact with pin 28 which subsequently contacts top structure 21 thereby causing said equipment to be retained in releasable securement with device 31. A locking cable (not shown) may be communicated through apertures 40 and pin aperture 44 thereby locking device 30.

When boots A and B are to be carried and/or secured with device 31 of FIG. 3 without poles C and skis D first manipulate securing means 7 counterclockwise causing it to move upward on column 4. Rotate boot retainers 36 upward into zone M (shown in FIG. 2). Raise hand grasp 33 upward and install heel of boot A into engagement with boot retention lip 22. Engage boot retainer 36 over boot toe. Repeat the above for boot B. Apply slight downward force upon hand grasp 33 while simultaneously manipulating securing means 7 clockwise until the proper holding force is applied to pin 28. Boots A and B are now releasably secured with device 31. A locking cable (not shown) may be communicated through pin aperture 44 thereby locking device 31. The cooperative consequence of the above resulting in a device 30 for carrying and/or securing any desired combination of equipment such as boots, skis and poles.

Although the device 30 has been illustrated and described herein for use in carrying and/or securing ski equipment, it is evident from a broader standpoint, that the purpose of device 30 is to carry and secure equipment of the nature illustrated whether it be equipment for skiing, hunting, tennis, golf, ice skates, fishing, roller skates, mountain climbing, industrial safety, some form of special tools or some class of special apparatus associated with a particular sport or work speciality which may be domestic or military in application. It should be understood, therefore, that it is not intended to limit the principles of the present invention to ski equipment alone, but rather to equipment according to the utilization principles of the present invention for various other uses, all of which are fully contemplated according to the features of the present invention.

It is instructive to teach certain alternative variations associated with device 30. The preferred embodiment of column members 4 and 6 depends on the details of manufacturing techniques and may be any geometric configuration ranging from circular to rectangular in cross section. The rectangular configuration has been illustrated for simplicity since it is obvious that these members are susceptible of change and modifications without departing from the principles, spirit and novel features of the invention. Resilient snap type retention means for poles C may be positioned any where along the longitudinal axis of pole chambers 19. Various reinforcing ribs may be selectively located to achieve appropiate strength characteristics. Resilient urging bands may be located internal to column 4 thereby providing an optional feature to facilitate equipment installation. Boots A and B of FIG. 1 may be reversed and the heels secured by retainers 36. The infinite adjustability feature of securing means 7 may be achieved by molding threads on column 6 and locating means 7 at the upper terminus of column 4 such that it is free to be rotated but does not move vertically. Column 4 may also be provided with any one of a variety of cam and ratchet type fastening mechanisms for adjusting column 6 up and down. Thus a securing means, of the class illustrated in FIGS. 2, 3, 4 and 5 provided with threaded connections, or other equivalent means for detachably mounting thus allows means 7 to infinitely adjust column 7 along the vertical axis of column 4. While there are other methods of accomodating a locking cable it should be noted that the method illustrated provides for ultimate security since the cable passes not only through the securing means 7, locking pin 28 but also the main column structures 4 and 6. Although not illustrated it is obvious that the standard combination type locking cable once attached to device 1 of FIG. 1 may then be attached to any convenient stationary object. Observe in FIG. 2 that oppositely disposed apertures 35 are provided in the lower portions of handle end abutments 32 such that boot retainers 36 may be optionally rotated therefrom. Should this option be utilized it may be seen by inspection of FIG. 3 that the retainers 36 could then be utilized as cooperative members of the securing means by bringing retainers 36 to rest upon the top surface 21 of unit 3. Thus, since means 7 would also be restrained and hence unit 3 would simultaneously be restrained. Also, it is significant to note that device 31 of FIG. 3 may be constructed to carry and/or secure skis and poles without any provisions for boots A and B. Note in FIG. 2 that the top surface 21 together with lips 22 of unit 3 may be located substantially at the extreme lower end of column 4 thereby converting device 30 to carry and/or secure boots A and B without any provisions for skis and poles. Securing means 7 can be rotatably secured to top of column 4 and adjustably secured to column 6 with threads such that means 7 does not move up or down.

To achieve optimum combination of dimensions F, H, O, P, Q and Z together with a functionally satisfactory configuration of securing means 7 it is instructive to teach that means 7 can have a dimension SM, shown in FIG. 5, such that the upper most portion extends up above pin 28 thereby causing turning ribs 45 to be located on a turning portion generally just below handle structure 32 which because of dimension F, shown in FIG. 1, provides greater freedom for operating means 7 when boots A and B are assembled therewith. Furthermore, the turning means 45 can be located within the hand grasp structure 33 and provisions for locking located therewith. Without boots A and B means 7 occupies the space generally designated by dimension P in FIG. 2 thereby allowing hand grasp 33 to retract such that dimension O approaches zero.

Among the variations suggested and taught by the illustrations and description is a securing means 7 that is held captive at the upper section of column 4 such that it is free to rotate but restrained against vertical motion whereby rotation of means 7 causes column 6 to move up and down. Securing means 7 may also be held captive in the upper section of column 6 when it is free to rotate only. Fully contemplated within the scope of this invention is a variety of ratchet and pawl and other shear type quick release mechanism. Working models of these and other variations are being tested and investigated.

Therefore, having disclosed the synthesis and analysis of construction features, including variations thereof, it is understood that the fundamental novel aspects of the invention can be achieved using a variety of substitutions and changes without departing from the spirit of the invention. The broad theory for the equipment carrying, securing and assembling techniques of this improved device 30 have been illustrated, described and pointed out including the fundamental novel features as applied to a preferred embodiment 30 comprised of, symmetrically related and oppositely disposed, mutually aligned parts manipulatively mounted onto centrally located retractile column members such that the cooperative consequences results in a device for selectively carrying and/or securing any desired combination of equipment such as boots, A, B, skis D and poles C.

According to the principles of the present invention therefore, methods and procedures for assembling any combination of equipment such as skis, poles and boots are provided within the device 1 of FIG. 1. In a single device 30 illustrated in FIG. 2 the means for carrying and/or securing any combination of said equipment uniquely retained in assembled interrelated positions, as shown in FIG. 1, ready for transporting, storage, securing and/or locking, or activities associated with the equipment retained therewith. Furthermore, according to the methods and procedural steps, and more specifically, the device 1 of FIG. 1 may be manipulated to provide all of the above features for skis and poles without boots as illustrated by device 31 of FIG. 3. Still further, from FIGS. 1 and 2 it is seen that boots may be afforded all of the above mentioned features without skis and poles. It follows, therefore, that this new device permits the manufacture of a simpler and less expensive device to achieve more combined functions than has heretofore been known.

All in all, the features of my new and improved carrying and/or securing device bring forth an advancement in the art over prior known devices and with the utilization of structural components and configurations as described produces a synergistic utility effect resulting in improved life and ruggedness for a device of the character described. It will also be recognized and appreciated that the utility of the unique yet simple mechanism, particularly the parts thereof, eliminates the need for maintenance repairs and/or replacement of parts since the structural integrity does not depend upon resilient biasing means. Securing and locking as used in the description hereinbefore refers to the capability of being secured by the owner such that unauthorized removal and/or use will not be permitted. It also means that the equipment is securely held captive with said device.

The selected modifications herein described for the adaption to a device 30 are set forth for the purpose of completing the disclosure. Depending on the manufacture and technique used, components molded from a variety of plastics, or other materials, have a good balance of properties and are adaptable to many design requirements. Decisions regarding which technique is best suited for the present invention rest primarily upon materials, economic, reliability and ease of performance.

Therefore, according to the principles of the present invention, a unique and novel equipment carrying and/or securing device is provided whereby an integrated method of assembling equipment that functions basically as a unit during transporting, storage or other uses. While it has been shown and described as a plurality of modified arrangements in which the invention may be embodied, it is to be understood that these constructions have been selected for the purpose of illustration and that various changes in size, shape and arrangement of the parts may be made without departing from the spirit of the invention or the scope of the subjoined claims. While I have shown and described constructions in which my invention may be embodied, it is to be understood, therefore, that variations in the construction and arrangement may be made without departing from the spirit and scope of the invention as disclosed in the appended claims, in which it is intended to claim all novelty inherent in the invention as broadly as permissible, in view of prior art. This invention further resides in the construction, combination and arrangement of elements illustrated in the accompanying drawings, and while I have shown thereon preferred embodiments, it is to be understood that the same is susceptible to modifications and changes; and comprehends other details, arrangement of elements, features and construction without departing from the spirit of the invention, and that all matters herein set forth or shown in the accompanying drawings are to be interpreted as illustrative and not in the limiting sense. In view of this disclosure, variations and modifications will doubtlessly be generated by others skilled in the art to obtain all, or part of the benefits of this invention without duplicating the framework shown, and I therefore claim all such variations and modifications insofar as they fall within the reasonable spirit and/or scope of my proposals and claims.

It is the intention, thus, to be limited only as indicated by the scope of the following claims. Accordingly, the scope of the invention should be determined not only by the embodiment illustrated, but by the appended claims and their legal equivalents, and all changes which come within the meaning and range of equivalence of the claims are therefore intended to be embraced therein.

Having thus described my invention, I claim as new and desire to secure by Letters Patent:

1. In a device for assembling, carry and/or securing any combination of ski equipment, or the like, such as boots, skis and poles, cooperable retention units, comprising a base member with an upstanding externally threaded, hollow column member with symmetrically related chambers for skis, a retention unit slideably engaged with said hollow column member, and an apertured column retention unit telescopically received within said hollow column member, said hollow column member having an internally threaded adjustable securing means engaged therewith and cooperating with an adjustment pin engaged within an aperture in said columned retention unit, the consequential operation of said cooperable retention units together with said securing means all relative to said base member according to a predetermined relationship for assembling said equipment into releasable securement therewith.

2. A ski equipment assembling, carrying and securing device comprising mutually aligned cooperable parts, boot retention means contained on a first and second of said parts, the securing means interfitting and being cooperable with an externally threaded, hollow base column member, the second of said parts having a column member telescopically received within said base column member, said parts and said securing means selectively manipulatable whereby both of said parts may be moved one relative to the other for selectively engaging any combination of ski equipment, such as boots, skis and poles into releasable securement therewith.

3. An equipment carrying mechanism for selectively securing a first, second, or third class of equipment, or any combination thereof, and including a base means having a hollow central column member supporting first, second and third retention units for respectively receiving first, second and third class of equipment into cooperable engagement therewith, said first retention unit comprising a column telescopically received within said hollow central column member, said base means having an external threads engaged with a manipulatable securing means mounted thereon and cooperating with said column in cooperation with an adjustment pin engaged within apertures in said column members for incremental adjustment thereof, said second retention unit movably mounted on said base means, said third retention unit disposed integrally with said second retention unit and substantially coextensive therewith, the consequential operation of said cooperable retention units together with said securing means all relative to said base means according to a predetermined relationship for assembling said equipment such as skis, poles and boots, or the like, into releasable securement therewith.

4. A device of the character described comprising a pair of mutually aligned and selectively manipulatable cooperative retention units, one of said retention units provided with means for retaining skis and poles, each of said retention units having releasable boot engaging means, each of said retention units mounted for guided movement on respective central column members having an internally threaded adjustable securing means releasable engaged thereto and adjustably disposed with external threads on one of said column members and cooperating with an adjustment pin engaged within an aperture in said column members such that the consequential functioning causes said equipment to be releasable secured with said device.

5. In a device for assembling, carrying and, or, securing any combination of ski equipment, or the like, such as boots, skis and poles, cooperable retention units, first of said units having symmetrically related boot retaining means oppositely disposed with respect to a first central column member to which the said retention unit is slidably engaged and adpated with yieldable biasing means to urge unit downward thereby releasably retaining said skis and poles, second of said retention units having internally threaded adjustable securing means releasably engaged thereto and adjustably disposed with external threads on said second retention unit and cooperating with an adjustment pin engaged within an aperture in said column member to effect retention of said boots between said retention units and to cause said first retention unit to be urged downwardly resulting in a compressive force being transmitted to both said first retention unit and said skis, said adjustable securing means manipulatively communicated with said column member thereby allowing any combination of said equipment to be selectively engaged into releasable securement therewith.

6. A ski equipment assembling, carrying and securing device comprising mutually aligned cooperable parts, boot retention means contained on a first and second of said parts, an internally threaded adjustable securing means engaged on the first of said parts and cooperating with an adjustment pin engaged within an aperture in said parts, said parts and said securing means selectively manipulatable whereby both of said parts may be moved one relative to the other for selectively engaging any combination of ski equipment such as boots, skis and poles into releasable securement therewith.

7. In a ski equipment assembling, carrying, displaying, transporting and/or securing device, cooperable units, first of said units having a pair of boot retainers oppositely disposed about a centrally located carrying means, second of said units having a pair of congruous boot retainers disposed symmetrically with respect to a pair of ski and pole retention means movably guided on a centrally located column having a pair of ski support bases at its lower extremity, internally threaded adjustable securing and locking means engaged with external threads on said column and cooperating with an adjustment pin engaged within an aperture in said column, said units selectively adjustable whereby any combination of said boots, skis and poles may be releasable secured and, or locked therewith.

8. In a method of assembling ski equipment and the like with a device for carrying and/or securing said equipment, said equipment being of the type comprising any combination of boots, skis and poles; the steps of: positioning poles parallel within releasable pole retention chambers; following said pole positioning said skis are positioned onto ski support bases after which a ski magazine unit is moved down into releasable retention therewith; inserting said boots into releasable engagement with oppositely disposed boot: retention members located generally above and perpendicular to the longitudinal axis of said poles and skis; and performing an adjustment operation after one or more of the above steps whereby said equipment is retained in releasable securement with said device, said adjustment comprising the manipulation of an internally threaded adjustable securing means engaged with external threads on a centrally located column member having an adjustment pin cooperating with said securing means and apertures in said column member.

9. A composite magazine and retainer for carrying and/or securing any combination of equipment such as skis, poles and boots, comprising retractile members selectively movable thereby effectuating the juxtapositioning of said equipment into cooperative assemblage therewith, a manipulatable internally threaded securing means adjustably communicating with external threads on one of said members provided with an adjustment pin cooperating with said securing means and apertures in said member, the consequential engagement of said members with said equipment thereby causing said equipment to be assembled into releasable securement.

10. An equipment carrying mechanism for selectively securing a first, second or third class of equipment, or any combination thereof, and including base means supporting first, second and third retention units for respectively receiving first, second and third class of equipment into cooperable engagement therewith, said first retention unit adapted for incremental adjustment relative to said base means, said second retention unit movable mounted onto said base means, said third retention units disposed integral with said second retention unit and substantially coextensive therewith, internally threaded manipulatable securing means engaged with external threads on said base means and cooperating with an adjustment pin engaged within an aperture in said base means and communicating between said first retention means and said base means, the consequential operation of said cooperable retention units together with said securing means all relative to said base means according to a predetermined relationship for assembling said equipment such as skis, poles and boots, or the like, into releasable securement therewith.

11. A composite retainer for carrying, assembling and, or, securing any combination of equipment such as skis, poles and boots, comprising retractile members selectively movable thereby effectuating the juxtapositioning of said equipment into cooperative assemblage therewith, an internally threaded manipulatble securing means engaged with threads on one of said retractile members and cooperating with an adjustment pin engaged within an aperture communicating between said members, the consequential operation of said retractile members together with said securing means all relative to a base means according to a predetermined relationship for assembling said equipment into releasable securement therewith.

* * * * *